United States Patent [19]

Bradley

[11] 4,112,717

[45] Sep. 12, 1978

[54] KEY BOX

[75] Inventor: Terrag W. Bradley, Monroe, Oreg.

[73] Assignee: Supra Products, Inc., Salem, Oreg.

[21] Appl. No.: 787,837

[22] Filed: Apr. 15, 1977

[51] Int. Cl.[2] ..... B65D 55/14; E05B 65/52

[52] U.S. Cl. ..... 70/63; 70/351

[58] Field of Search ..... 70/63, 351, 404, 422

[56] References Cited

U.S. PATENT DOCUMENTS

| | | | |
|---|---|---|---|
| 3,084,008 | 4/1963 | Mallett | 70/63 |
| 3,237,436 | 3/1966 | Williams | 70/63 |
| 3,436,937 | 4/1969 | Barrett | 70/63 |

*Primary Examiner*—Richard E. Moore

*Attorney, Agent, or Firm*—Klarquist, Sparkman, Campbell, Leigh, Hall & Whinston

[57] ABSTRACT

A key box in which an inaccessible interior latch secures a drawer in place. An exposed lock can be operated to release the latch. A tumbler lock has forward and rearward tumbler receiving notches of different depths to make picking of the lock more difficult.

5 Claims, 10 Drawing Figures

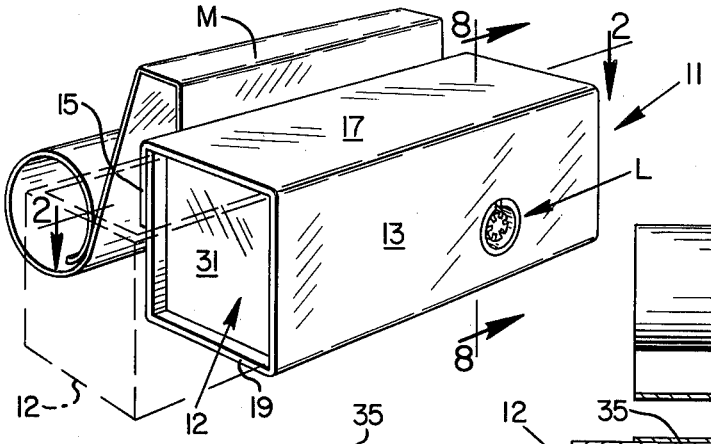
FIG. 2
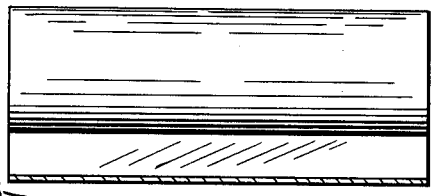
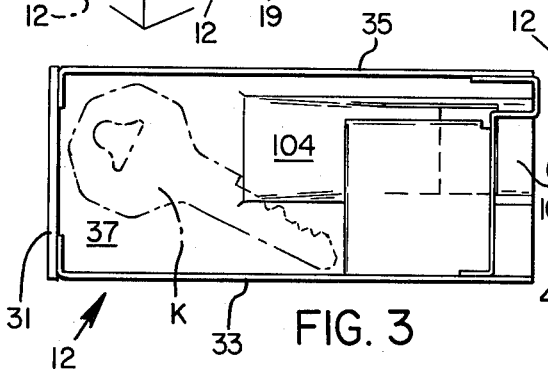
FIG. 3
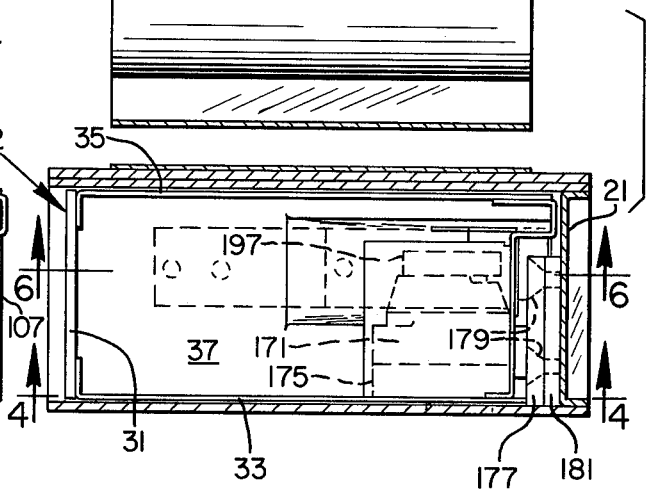
FIG. 5
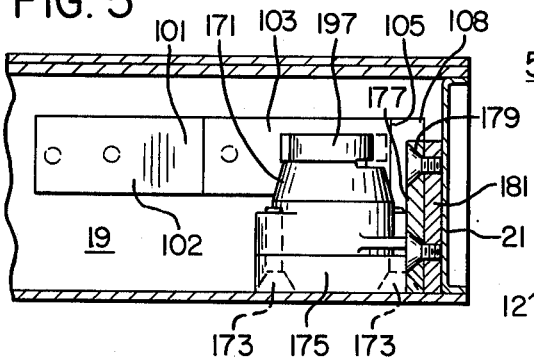
FIG. 4
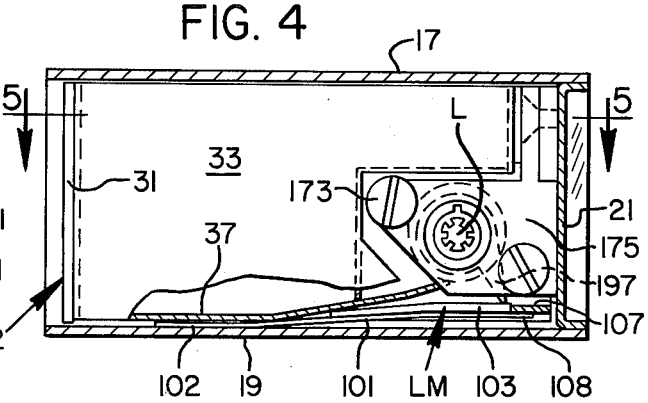
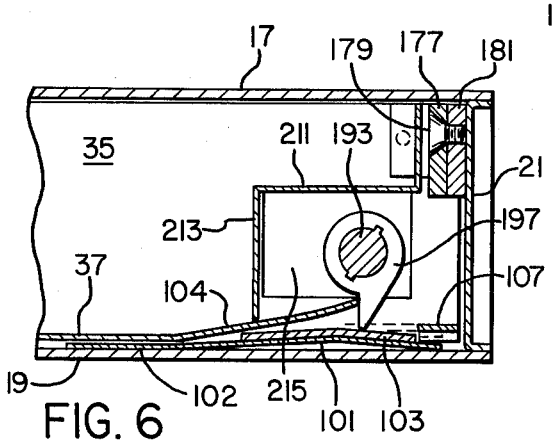
FIG. 6
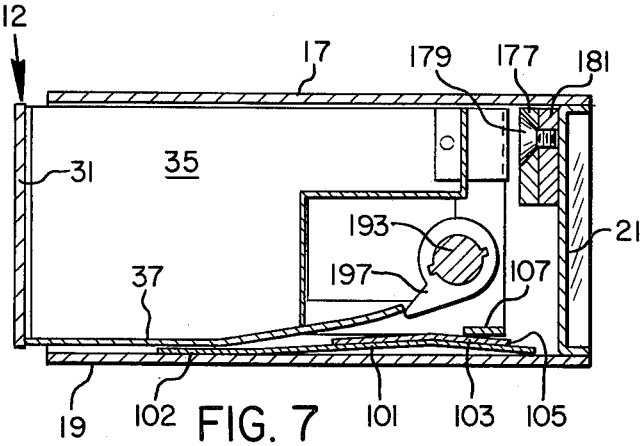
FIG. 7

FIG. 8
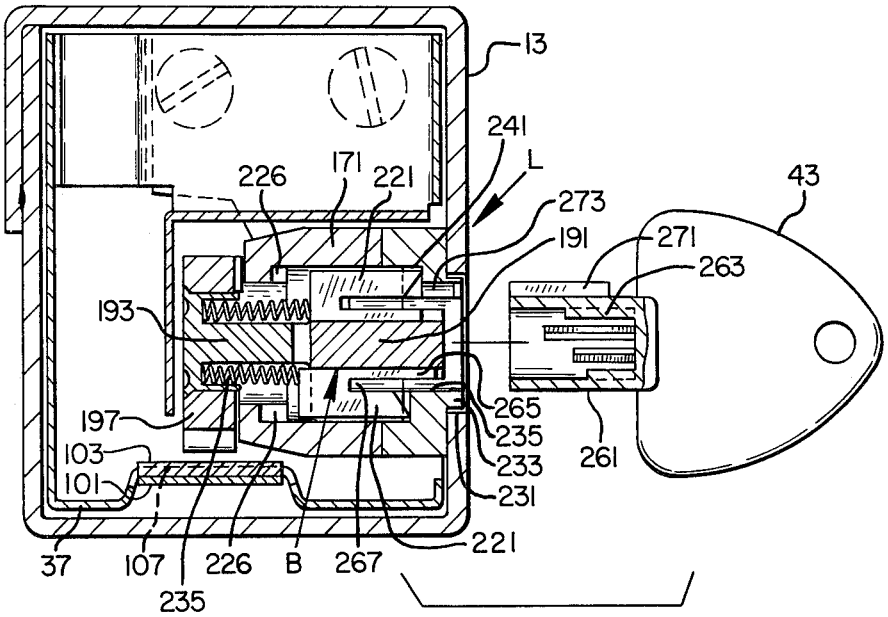
FIG. 9
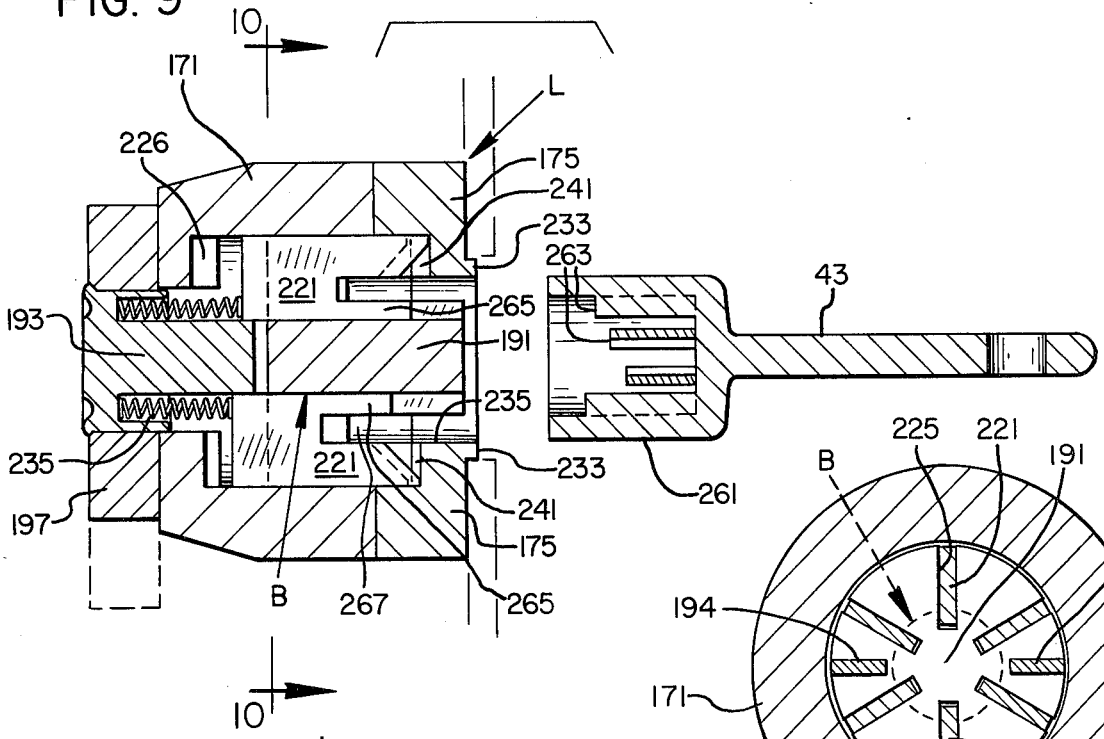
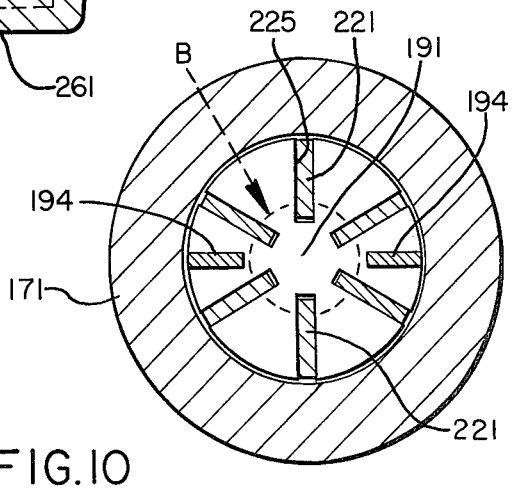
FIG. 10

KEY BOX

BACKGROUND OF THE INVENTION

Prior key boxes, of the casing and drawer type, have utilized a key-operated lock mechanism to lock the drawer in place. These locks are conventionally formed of "pot" metal, such as zinc alloy. In certain instances a thief has been able, with special tools, to apply an outward prying force on the drawer, to break certain parts of the lock to gain access to the interior of the key box. While it would be possible to strengthen the lock mechanism by forming the parts from steel, this would be very expensive.

SUMMARY OF THE INVENTION

The present invention provides a simple but rugged inaccessible latching mechanism for the drawer, separate from the lock, the lock being relied upon only to release the latching mechanism.

The lock of the present invention has tumbler receiving notches to make it very difficult for even a professional thief to successfully pick the lock.

It is an object of the invention to provide an improved key box which resists forceable entry better than prior key boxes of which I am aware.

Another object of the invention is to provide an improved lock that resists picking better than prior locks.

BRIEF DESCRIPTION OF THE DRAWINGS

In the drawings:

FIG. 1 is a perspective view of a key box of the present invention showing in phantom lines the drawer partly withdrawn;

FIG. 2 is a horizontal sectional view taken along line 2—2 of FIG. 1;

FIG. 3 is a plan view of the drawer, showing in broken lines a key contained within the drawer;

FIG. 4 is a vertical sectional view through the key box taken along line 4—4 of FIG. 2;

FIG. 5 is a horizontal sectional view taken along line 5—5 of FIG. 4, with the drawer removed;

FIG. 6 is a vertical sectional view taken along line 6—6 of FIG. 2, showing the lock as having been operated to release the drawer;

FIG. 7 is a view similar to FIG. 6, but showing a subsequent stage of operation;

FIG. 8 is a vertical cross sectional view through the key box taken along lines 8—8 in FIG. 1, and showing a key in position for insertion into the lock of the key box;

FIG. 9 is a cross section of the lock and key on an enlarged scale; and

FIG. 10 is a cross section taken along line 10—10 of FIG. 9.

The key box comprises a rectangular case 11 (FIG. 1) slidably receiving a drawer 12, which is of a size to receive a car key K, as shown in FIG. 3. The box may be mounted in any suitable manner, one way being shown in FIG. 1, which comprises a hook-like mounting member M to fit on the upper margin of the window glass of a car door.

The case 11 has a front wall 13 (FIG. 1), a rear wall 15, an upper wall 17, a lower wall 19, and an end wall 21 (FIG. 2). The opposite end of the case is open to receive the drawer 12. The drawer has a end wall 31 (FIGS. 1 and 2) which closes the opposite end of the case when the drawer is locked within the case. The drawer has upstanding side walls 33 and 35 (FIG. 2) and a bottom wall 37.

FIG. 4 shows that the drawer is sufficiently shorter than the interior length of the case 11 so that the end wall 31 of the drawer, when the drawer is fully in place, is spaced inwardly from the associated end of the case. This is a safeguard to make it difficult for someone forcibly to open the key box. Also note that the end wall 21 of the case is in the form of a cup piece welded in place, which makes it difficult for the end wall to be pried off.

The drawer can be locked within the case by means of a latch mechanism generally entitled LM (FIG. 4), the mechanism being released by a lock L. The lock, and the key 43 (FIG. 8) for actuating the lock, are of the general type disclosed in U.S. Pat. No. 3,237,463. There are certain important differences as will be evident presently.

The latch mechanism LM includes a flexible leaf 101 which is secured at 102 to the bottom wall 19 of the case 11. The leaf carries a rigid latching element 103 which is accommodated within an opening provided in the bottom wall 37 of the drawer by an upwardly bent tang 104. The forward edge 105 of the latching element 103 is adapted to catch on a bridging portion 107 (FIGS. 4 and 8) forming a part of the bottom wall of the drawer, to positively retain the drawer in place, until displacement of the latching element. It is pointed out that the leaf 101 urges the latching element 103 upwardly, while an end portion 108 of the leaf, which extends beyond the end 105, abuts against the bottom surface of the bridging portion 107 to dispose the edge 105 in alignment with the bridging portion.

It is thus evident from FIGS. 4, 6 and 7 that it is the latching structure which actually retains the drawer in place, and not the lock L.

Referring to FIGS. 5 and 8, the lock includes a cylinder 171 secured by screws 173 to one leg 175 of an angular mounting bracket. The other leg 177 is at right angles to the leg 175 and is secured by screws 179 to a steel mounting plate 181 welded to the end wall 21. The leg 175 forms a continuation of the cylinder 171, as will be apparent presently.

The cylinder 171 contains a two part barrel B having a front section 191 (FIG. 8) and a rear section 193 keyed together at 194 (FIG. 10) for concurrent movement. The rear portion of rear section 193 projects from the cylinder 171 and has an actuating cam 197 fixed to it. The barrel could be made of a single piece, if desired.

When the drawer is locked in place, the cam 197 is in the dotted line position shown in FIG. 4, beyond overcenter, and thus does not interfere with the latching function of the latch mechanism LM. However, if the key 43 in FIG. 8 is inserted in the lock L and the cam 197 turned to its FIG. 6 position, the cam 197 will depress the flexible leaf 101 and its latch element 103 to disengage the edge 105 from the bridging portion 107 to unlock the drawer. The cam thereupon engages the tang 104 to shove the drawer outwardly. This outward movement need only be sufficient to move the bridging wall 107 beyond the edge 105 of the latch, and to move the drawer outwardly beyond the end wall defining the open end of the casing a distance sufficient to enable the drawer to be grasped and pulled out.

The lock itself is conveniently produced of cast pot metal parts which are not very strong. Thus, if the cam were relied upon to retain the drawer in place, a clever thief might apply sufficient outward pressure on the drawer to break the lock L and release the drawer.

However, in the present key box, the lock is not relied upon to retain the drawer in place. Instead, it is the abutment of rugged steel elements, such as plate 103 and the bridging portion 107 of bottom wall 37 of the drawer, that retain the drawer in place. This construction is many times stronger than that which would be provided if the lock were relied upon to hold the drawer in place.

The drawer is provided at its rear portion with interior walls 211, 213 and 215 defining a compartment or alcove to accommodate the lock L. This keeps the key K from getting entangled in the operation of the lock and latch mechanism.

Referring to FIGS. 8 and 9, the lock L is similar to the lock of U.S. Pat. No. 3,237,436 in having plural tumblers 221 sliding in slots 225 (FIG. 10) formed in the barrel sections 191 and 193. The cylinder 171 has a rear shoulder formed with plural notches 226 forming continuations of the slots 225, when the slots are aligned with the notches. A similar set of notches 241 are provided in the leg 175.

Compression springs 235, there being one for each tumbler, are seated in sockets provided in the rear barrel section 193, and urge the tumblers 221 to forward positions seated within the forward notches 241. The notches are made of different depths for a purpose to presently appear.

The front wall 13 of the case has a circular opening 231 (FIGS. 8 and 9) formed therein to receive a forwardly projecting circular rib 233 formed on the leg 175. The rib (FIG. 9) is defined in part by a bore 235 formed in the leg 17. The bore receives the forward portion of the barrel B, and the key 43, which has a tubular portion 261 to fit over the forward portion of the barrel 191 and to fit within the bore 235.

The key, shown in FIG. 8, is of the type shown in U.S. Pat. No. 3,237,436 in having a tubular part 261 of a size to fit with a plurality of interior fins, all labeled 263, provided on the interior of the tubular piece. The fins are adapted to selectively engage forwardly extending contact prongs 265 of the tumblers, the tumblers being recessed at 267 to receive the tubular portion 261 of the key.

The contact prongs 265 are of different lengths, as are the fins 263 and the notches 226 and 241. In order to unlock the lock, the tumblers must be selectively moved to positions clearing the forward notches while not entering the rear notches. This means that each tumbler must be moved a different amount depending on the above parameters. The lengths of the fins 263 are chosen to bring this about.

With notches of different depths, it is much more difficult for a person, intending to pick the lock, to determine the depths to which the various tumblers must be pushed for clearance purposes.

The key 43 has a keying element 271 fitting within an appropriate slot 273 provided in the leg 175 to properly orient the key relative to the tumblers.

If it is desired to change the combination of the lock, the drawer 12 can be removed to expose the screws 179. Removing these enables removal of the bracket along with the lock. Removing screws 173 enables the tumblers to be repositioned in different slots 225 of the barrel to fit the code of another key.

The latching mechanism LM may be considered as a first locking means, and the lock L as a second locking means.

If an attempt is made to forcibly enter the key box, by engaging the barrel with a tool and turning it against the resistance of the tumblers, portions of the front barrel section will break before the tumblers give way, thereby to insure against successful forceable entry via the lock L.

What is claimed is:

1. In a key box, a case, a drawer slidable into the case, first locking means within the case for locking the drawer against removal, and second locking means exposed at the exterior of the case for actuating the first locking means and for pushing said drawer outwardly, said second locking means having a lost motion action to facilitate actuation of the first lock means prior to exerting a pushing force against said drawer.

2. A key box as recited in claim 1 wherein said first locking means includes a flexible latch leaf secured to the interior of said case, a stop on the drawer engaged by the leaf in the locked position of the drawer, said second lock means including an arm engageable with a portion of said drawer to actuate said drawer, said arm also being operable to inactivate said leaf, said arm being disposed relative to said portion and said leaf so as to inactivate said leaf prior to actuating said drawer.

3. In a key box as recited in claim 1 wherein said second locking means includes axially slidable tumblers of different effective lengths, a cylinder means having notches to receive said tumblers, said notches being of different depths to make difficult picking of the lock.

4. A lock having a housing means having an axis, a barrel turnable in said housing means formed with axially extending radial slots, tumblers axially slidable in said slots, said housing means providing a set of notches to receive ends of said tumblers in extreme positions of movement of said tumblers, said notches being of different depths.

5. A lock as recited in claim 4 wherein said housing means provides a second set of notches for receiving other ends of said tumblers, said second set of notches also being of different depths.

* * * * *